US008128434B1

(12) United States Patent
Gandolfi et al.

(10) Patent No.: US 8,128,434 B1
(45) Date of Patent: Mar. 6, 2012

(54) ELECTRICAL ADAPTER WITH FUSE

(75) Inventors: Paul R. Gandolfi, Dade City, FL (US); Kerrie L. Campbell, Chevy Chase, MD (US); Peter A. Czerner, Plant City, FL (US); Frank S Brugner, Clearwater, FL (US); Douglas B Tilghman, Tampa, FL (US)

(73) Assignee: Technology Research Corporation, Clearwater, FL (US)

( * ) Notice: Subject to any disclaimer, the term of this patent is extended or adjusted under 35 U.S.C. 154(b) by 243 days.

(21) Appl. No.: 12/589,419

(22) Filed: Oct. 23, 2009

Related U.S. Application Data

(60) Provisional application No. 61/197,907, filed on Oct. 31, 2008.

(51) Int. Cl.
*H01R 13/68* (2006.01)

(52) U.S. Cl. ..... 439/620.31

(58) Field of Classification Search ..... 439/620.26, 439/620.31; 337/197
See application file for complete search history.

(56) References Cited

U.S. PATENT DOCUMENTS

| | | | | |
|---|---|---|---|---|
| 1,968,213 | A * | 7/1934 | Lofgren | 337/197 |
| 6,753,755 | B2 * | 6/2004 | Montague | 337/265 |
| 2008/0012681 | A1 * | 1/2008 | Kadar et al. | 337/298 |

* cited by examiner

*Primary Examiner* — Edwin A. Leon
*Assistant Examiner* — Vanessa Girardi
(74) *Attorney, Agent, or Firm* — Frijouf, Rust & Pyle, P.A.

(57) ABSTRACT

An electrical adapter is disclosed for providing overload protection between a conventional electrical receptacle and an external electrical plug comprising a housing comprising a plug housing portion and a receptacle housing portion. Electrical blades are supported to protrude from the plug housing portion for insertion within the conventional electrical receptacle. Electrical receptacles are supported within the receptacle housing portion for receiving an external conventional electrical plug. An over current fuse provides over current protection between the conventional electrical receptacle and the external electrical plug. The electrical adapter may include a thermal fuse to provide over heating protection between the conventional electrical receptacle and the external electrical plug.

8 Claims, 10 Drawing Sheets

ELECTRICAL ADAPTER WITH FUSE

CROSS-REFERENCE TO RELATED APPLICATIONS

This application claims benefit of U.S. Patent Provisional application No. 61/197,907 filed Oct. 31, 2008. All subject matter set forth in provisional application No. 61/197,907 filed Oct. 31, 2008 is hereby incorporated by reference into the present application as if fully set forth herein.

FIELD OF THE INVENTION

This invention relates to electrical protection circuits and more particularly to an electrical adapter providing electrical current protection and/or temperature protection between a conventional electrical receptacle and an external electrical plug.

BACKGROUND OF THE INVENTION

A conventional electrical service comprises a power cable from the electrical provider to the electrical user with the power cable entering into a main circuit breaker box. Typically, the circuit breaker box comprises a main circuit breaker and a plurality of branch circuit breakers for providing over current protection to the various branch circuits. The overload current threshold for each of the branch circuit breakers is selected to accommodate for multiple loads in each branch circuit.

Although the above conventional electrical service provides an efficient and safe system for providing electrical power to an electrical user, there is in need in the prior art to provide additional circuit protection and/or interruption capabilities for each of the multiple loads in each of the branch circuits. The following United States patents have suggested solutions for providing additional circuit protection and/or interruption capabilities or each of the multiple loads in each of the branch circuits.

U.S. Pat. No. 1,974,700 to Adams discloses a plug including mating body sections having registering recesses opening through the top of the plug. Prongs are clamped between the sections with a terminal clamped between the sections but free with respect thereto. A removable fuse is seated in the registering recesses and extending between the terminal and one of the prongs. An ejecting device independent of the fuse projects through one end of the plug for ejecting the fuse through the other end of the plug. Yieldable means return the ejecting device to normal position. Means connect the sections and clamping the prongs and the terminal therebetween.

U.S. Pat. No. 1,990,176 to Fried discloses fuse adapter comprising a body member formed of insulating material and a pair of fuse supports arranged within the body in insulated relation to each other collectively constituting a run-way to longitudinally slidably support a fuse. Means are provided by which electrical conductors may be connected with the fuse supports respectively. The body has a passage extending from exteriorly thereof to adjacent one end of the run-way through which a fuse may be moved along the run-way out of the body.

U.S. Pat. No. 2,644,056 to C. Curtis discloses a fused, polarized, electrical coupling comprising an insulated housing, a pair of through conductors insulated from each other therein with one terminating in a ground blade and the other in a hot line blade having a smaller cross section than the ground blade, and a removable cartridge fuse in the hot line.

U.S. Pat. No. 2,676,223 to W. Whitaker discloses an electric plug connector comprising a body of an insulating material having a pair of elongated parallel cavities within the same and communicating with slotted apertures opening through an end face thereof. One of the cavities has a greater depth than that of the other cavity. Resilient con-tact elements are housed within the cavities. The body also has a tubular bore extending laterally outward from the inner end of the one cavity and opening through a side face of the body. A resilient tongue extends from the contact element within the one cavity and having a free end disposed across the inner end of the bore. The bore is adapted to receive a fuse element therein with the inner end of the element disposed in contact with the tongue. The body has a counter-bore in the side face in concentric relation with respect to the first bore. A metallic sleeve is provided with a bayonet slot tight fitted within the counter-bore. A plug electrode projects laterally outward through the side face from the inner end of the contact element within the other cavity. A second plug electrode having a cylindrical enlargement at the inner end of the second electrode seated in the sleeve and against the outer end of the fuse element. A pin projects radially from the enlargement for engagement with the bayonet slot to effect the locking of the enlargement and the associated electrode in place.

U.S. Pat. No. 2,988,617 to M. Graziosi discloses a fused connector for an electrical appliance comprising a body member of insulating material having cutaway portions for fuse retention and a pair of fuse-aligned fuse ejection access holes substantially smaller than a fuse diameter. A pair of parallel contact blade means protrude from one end of the body member and fastened thereto. First fuse clip means on each of the blade means comprises a pair of jaws adapted for resilient engagement of only the circumference of one end of a generally cylindrical fuse body. A pair of contact blade socket means are adapted by reentrant curvature for resilient blade engagement and fastened to the body member in the cutaway portions for engaging blades inserted in an opposite end thereof. Second fuse clip means on each of the socket means are aligned with and spaced from the first fuse clip means a fuse length distance. Grounding blade socket means comprises a resilient clip in parallel alignment with the blade means and fastened to the body member. Grounding means and an open ended housing is slidable over the body member and the blade means having apertures of greater than fuse diameter aligned with the clip means and apertures for the blade means and the grounding means.

U.S. Pat. No. 3,218,413 to R. Koch discloses a fused connecting plug for insertion in one of the socket units of a multiple unit receptacle. A flat rectangular insulating housing has a pair of parallel main walls joined around the periphery by a short sidewall to define a thickness less than the spacing between the socket units of a receptacle. A pair of laterally spaced plug prongs are secured within the housing and projecting outwardly through the side wall. A pair of correspondingly laterally spaced prong receiving sockets are aligned with and spaced from the plug prongs, the housing having opening means aligned with the sockets for insertion of prongs into the sockets. A fuse is disposed to one side of an aligned prong and socket in the housing and connected thereto to complete the circuit. A thin lamp means is mounted in the housing between the parallel main walls and spanning the aligned prong and socket connected to the fuse and thereby being connected in parallel with the fuse and illuminated upon disruption of the fuse, the housing a viewing opening for detection of the illumination.

U.S. Pat. No. 3,539,961 to Worthington discloses a device for isolating an electrical appliance operating at the current and voltage levels normally used with household appliances from an electric current in excess of a predetermined value. A housing supports a plurality of prong means adapted to be inserted into a grounded electrical receptacle and a female receptacle adapted to be electrically connected to an appliance. A plurality of electrode means are connected to each the prong means and extending inwardly of the housing. Fusible means is connected between at least two of the electrode means and the female receptacle. The fusible means is adapted to electrically disconnect the two electrode means and the female receptacle when the fusible means are caused to carry an electric current in excess of a predetermined value. Hollow means define an air chamber surrounding the electrode means. The hollow means is supported by portion of the housing means and is closed at one end by the portion of the housing and open at the end adjacent the ends of the electrode means remote from the prong means. The connection between the fusible means and the electrode means is within the air chamber. Arc means is disposed in the housing adjacent to the ends of the two electrode means remote from the prong means and spaced therefrom to define a spark gap. The arc means is electrically connected to another of the prong means so that when the two electrode means and the receptacle are electrically disconnected, current in the two prong means is conducted to the other prong means by way of the spark gap and the arc means.

U.S. Pat. No. 3,924,914 to P. Banner discloses an electrical safety grounding devices of the type for single-phase two and three wire systems. The electrical safety grounding device features improved electrical grounding capability for plugs, connectors, receptacles and adapters having improved fuse protection and signal response indicating means protecting life and equipment in the daily use of electricity.

U.S. Pat. No. 4,275,374 to D. Chaucer discloses a string of Christmas lights including a plug adapted to receive an electrical fuse within a lower insertion opening in the plug-face from which the male prong elements extend from the plug such that when the plug is withdrawn from a socket a fuse may be inserted or withdrawn. The insertion opening for the electrical fuse is continuous with a fuse-holding channel having a small opening too small for insertion or withdrawal of the fuse. An object may be inserted through the small opening to press-against a fuse within the channel in order to push the fuse out-of the lower insertion opening while maintaining the plug in an assembled state.

U.S. Pat. No. 4,758,184 to W. Call discloses an electrical plug housing having a base part and a fuse part. Both parts fit together and secure electrical contact members that provide male and female plug connections. One of the members comprises two sections each of which is in engagement with a fuse connector. The housing fuse part includes transverse openings that extend from a compartment in the housing face. One end of the fuse connector extends through the transverse opening and engages one of the contact member sections. The opposing end provides a clamp for one end of a fuse.

U.S. Pat. No. 5,137,473 to A. Nickola discloses a fused protection device to be installed between a conventional male and a conventional female electrical plug and adapted to receive a fuse to thereby isolate and protect an appliance or the like from overloading a circuit. U.S. Pat. No. 5,451,173 to C-L. Mai discloses a safety plug including an insulative base frame mounted within an insulative housing to hold a positive contact metal blade and a negative contact metal blade. A tubular fuse is connected between the hot wire of an electric cord and the positive contact metal blade to automatically cut off the circuit upon an electric overload. U.S. Pat. No. 6,753,755 to W. Montague discloses an electrical safety connector fuse for insertion into a two- or three-pin electrical socket comprises a sealed, tamper-proof housing having live and neutral apertures, and live and neutral receptacles for receiving the prongs of a plug, live and neutral prongs for insertion into the socket, and a fuse disposed within the housing. The connector fuse desirably has an internal light which lights up when the fuse is connected to a live socket, a blocking member or gate to prevent a user from receiving an electric shock by inserting objects into the live aperture of the fuse, and an insulting coating on at least a part of the live prong to prevent electric shocks as the fuse is inserted into a socket.

Therefore, it is an object of the present invention to provide an electrical adapter for providing protection between a conventional electrical receptacle and an external electrical plug.

Another object of this invention is to provide an electrical adapter for providing electrical current overload protection between a conventional electrical receptacle and an external electrical plug.

Another object of this invention is to provide an electrical adapter for providing temperature protection between a conventional electrical receptacle and an external electrical plug.

Another object of this invention is to provide an electrical adapter that is disposable upon an electrical current overload and/or a temperature overheating of the electrical adapter.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an electrical adapter for providing overload protection between a conventional electrical receptacle and an external electrical plug comprising a housing comprising a plug housing portion and a receptacle housing portion. A plurality of electrical blades are supported by the plug housing portion to protrude from the plug housing portion for insertion within the conventional electrical receptacle. A plurality of electrical receptacles are supported within the receptacle housing portion for receiving an external conventional electrical plug. An over current fuse interconnects the one of the plurality of electrical blades to one of the plurality of electrical receptacles for providing over current protection between the conventional electrical receptacle and the external electrical plug.

In a more specific embodiment, the plug housing portion is secured to the receptacle housing portion for enclosing the over current fuse. The plug housing portion includes a plurality of blade apertures for enabling the plurality of electrical blades to extend therethrough. The receptacles housing portion has a plurality of blade supports for retaining the plurality of electrical blades within the plurality of blade apertures of the plug housing portion. The plug housing portion includes a plurality of blade apertures for enabling the plurality of electrical blades to extend therethrough.

In another specific embodiment, the receptacles housing portion has a plurality of blade supports extending from the receptacles housing portion for retaining the plurality of electrical blades within the plurality of blade apertures of the plug housing portion. The plug housing portion includes a plurality of sockets for receiving the plurality of electrical receptacles. The receptacles housing portion has an inner surface for retaining the plurality of electrical receptacles within the plurality of sockets of the plug housing portion. The receptacle housing portion plug includes a plurality of receptacle apertures aligned with the plurality of electrical receptacles for enabling the electrical blades of the external electrical plug to extend therethrough.

In another embodiment, the invention is incorporated into an electrical adapter for providing current overload protection and over heating protection between a conventional electrical receptacle and an external electrical plug. The electrical adapter comprises a housing having a plug housing portion and a receptacle housing portion. A plurality of electrical blades are supported by the plug housing portion to protrude from the plug housing portion for insertion within the conventional electrical receptacle. A plurality of electrical receptacles are supported within the housing for receiving an external conventional electrical plug. An over current fuse interconnects one of the plurality of electrical blades to one of the plurality of electrical receptacles for providing over current protection between the conventional electrical receptacle and the external electrical plug. A thermal fuse is located in thermal contact with at least one of the plurality electrical blades and the plurality electrical receptacles for terminating electrical conduction between the conventional electrical receptacle and the external electrical plug upon an over heated condition of the electrical adapter.

In a one embodiment, the thermal fuse is connected in series with the over current fuse between one of the plurality electrical blades and one of the plurality of electrical receptacles. In another embodiment, the over current fuse is connected between one of the plurality electrical blades and one of the plurality of electrical receptacles. The thermal fuse is connected between the other of the plurality electrical blades and the other of the plurality of electrical receptacles.

In still a further embodiment, the over current fuse includes a first and a second terminal. The first and second terminals of the over current fuse interconnect one of the plurality of electrical blades to one of the plurality of electrical receptacles for providing over current protection between the conventional electrical receptacle and the external electrical plug. The thermal fuse includes a first and a second terminal. The first and second terminals of the thermal fuse interconnect one of the plurality of electrical blades to one of the plurality of electrical receptacles for providing thermal protection between the conventional electrical receptacle and the external electrical plug.

In still a further embodiment, the invention is incorporated into an electrical adapter for providing thermal protection between a conventional electrical receptacle and an external electrical plug comprising a housing comprising a plug housing portion and a receptacle housing portion. A plurality of electrical blades are supported by the plug housing portion to protrude from the plug housing portion for insertion within the conventional electrical receptacle. A plurality of electrical receptacles are supported within the receptacle housing portion for receiving an external conventional electrical plug. A thermal fuse interconnects the one of the plurality of electrical blades to one of the plurality of electrical receptacles for providing thermal protection between the conventional electrical receptacle and the external electrical plug.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
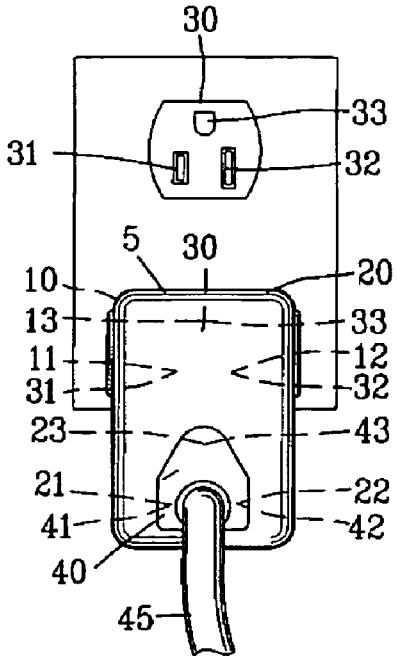
FIG. 1 is a front view of a first embodiment of an electrical adapter of the present invention inserted into a conventional electrical receptacle.
Figure 2:
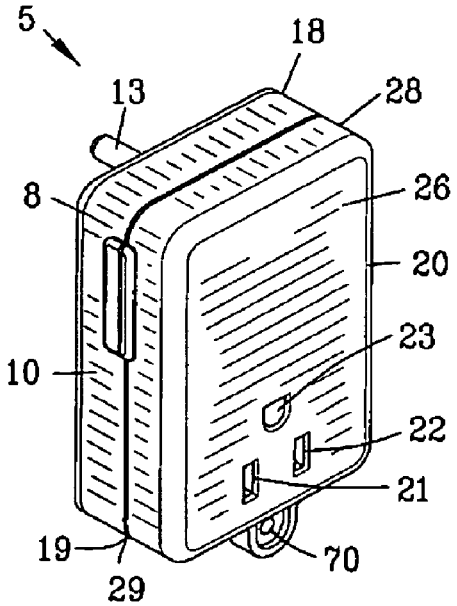
FIG. 2 is an isometric front view of the electrical adapter of FIG. 1.
Figure 3:
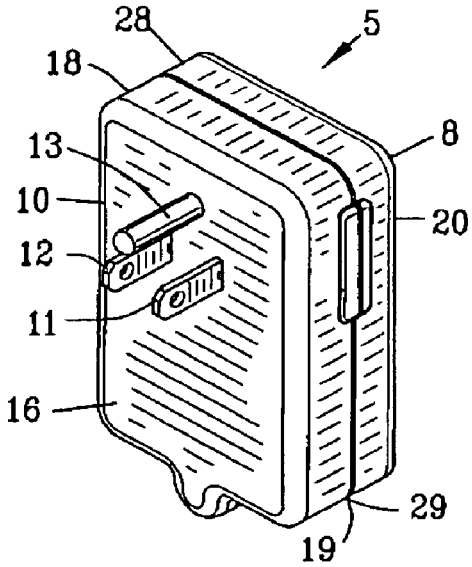
FIG. 3 is an isometric rear view of the electrical adapter of FIG. 1.

FIGS. 1-3 illustrate a first embodiment of an electrical adapter 5 of the present invention. The electrical adapter 5 includes a housing 8 comprising a plug housing portion 10 and a receptacle housing portion 20. A plurality of electrical blades 11-13 are supported by the plug housing portion 10 to protrude from the plug housing portion 10. A plurality of electrical receptacles 21-23 are supported within the receptacle housing portion 20.

In this example, the electrical blades 11-13 are shown as a line blade 11, a neutral blade 12 and a ground blade 13. The plurality of electrical receptacles 21-23 are shown as a line receptacles 21, a neutral receptacles 22 and a ground receptacles 23.

A conventional electrical receptacle 30 comprises a line electrical receptacle 31, a neutral electrical receptacle 32 and a ground electrical receptacle 33. The conventional electrical receptacle 30 is shown as a conventional NEMA 5-15R 120 volt 15 ampere electrical service. However, it should be understood that the present invention may be adapted to various types of conventional electrical receptacles such as a NEMA 5-20R, a NEMA 6-15R or a NEMA 6-20R.

A conventional external electrical plug 40 comprises a line blade 41, a neutral blade 42 and a ground blade 43. A power cord 45 interconnects the electrical blades 41-43 to a load (not shown).

The conventional electrical plug 40 is shown as a conventional NEMA 5-15P but it should be understood that the present invention may be adapted to various types of conventional electrical plugs such as a NEMA 5-20P, a NEMA 6-15P or a NEMA 6-20P. The electrical blades 11-13 of the plug housing portion 10 are insertable into conventional electrical receptacle 30: The electrical blades 41-43 of the conventional external electrical plug 40 are insertable into electrical receptacles 21-23 of the receptacle housing portion 20.

As will be described in greater detail hereinafter, the plug housing portion 10 is secured to the receptacle housing portion 20 for enclosing an over current fuse 80. The over current fuse 80 interconnects the one of the plurality of electrical blades 11 and 12 to one of the plurality of electrical receptacles 21 and 22 for providing over current protection between the conventional electrical receptacle 30 and the external electrical plug 40.

Figure 4:
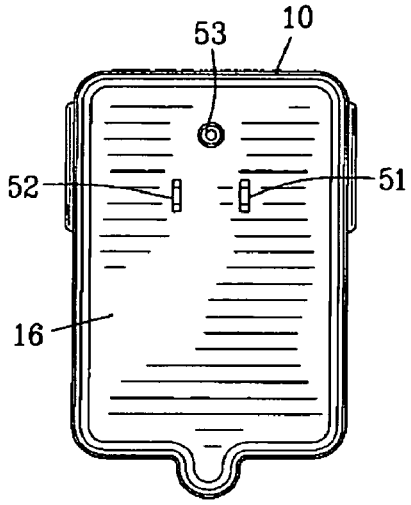
FIG. 4 is a view of an outside surface of a plug housing portion of the electrical adapter of FIGS. 1-3.
Figure 5:
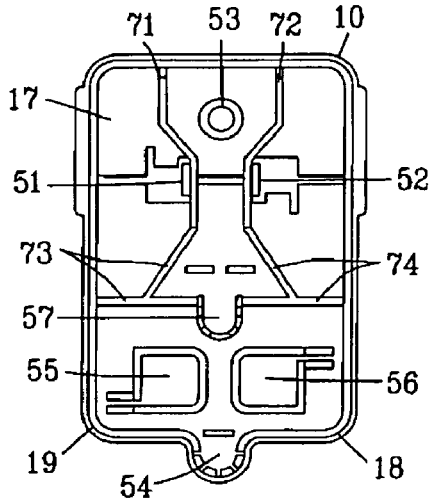
FIG. 5 is a view of an inside surface of the plug housing portion of FIG. 4.

FIGS. 4 and 5 illustrate the plug housing portion 10 having an outer surface 16 and an inner surface 17. A peripheral wall 18 extends from the inner surface 17 and terminates in a distal end 19. A plurality of blade apertures 51-53 extend between the outer surface 16 and the inner surface 17 of the plug housing portion 10. The blade apertures 51-53 are defined within the plug housing portion 10 for enabling the plurality of electrical blades 11-13 to extend through the blade apertures 51-53 with the proper blade orientation. In this example, the blade apertures 51 and 52 are orientated to position the electrical blades 11 and 12 in a parallel relationship as shown in FIGS. 3 and 4 for use with a conventional NEMA 5-15P 120 volt 15-ampere electrical service.

The plug housing portion 10 includes a plurality of sockets 54-57 defined within the plug housing portion 10. An illuminator socket 54 is provided for mounting an illuminator device 90 such as a light emitting diode (LED) shown in FIG. 8. Receptacle sockets 55-57 are defined within the within the plug housing portion 10 for receiving the line receptacle 21, the neutral receptacle 22 and the ground receptacle 23, respectively.

Plug housing shields 71 and 72 extend from the plug housing portion 10 for providing insulating walls between the blade apertures 51-53 within the plug housing portion 10. Strengthening ribs 73 and 74 extend outwardly from the inner surface 17 for providing mechanical strength to the plug housing portion 10. Preferably, the plug housing portion 10 is molded as a one piece unit from a polymeric material. Preferably, pins are inserted into a mold (not shown) for forming the blade apertures 51-53 during the molding process.

Figure 6:
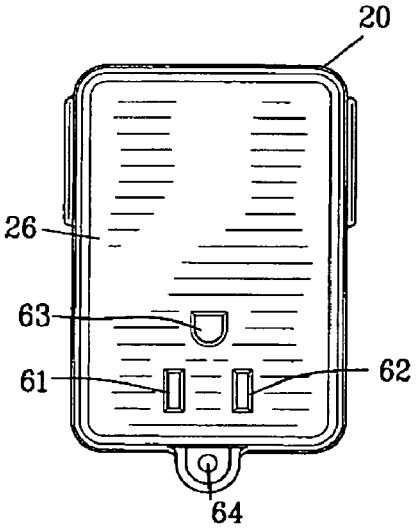
FIG. 6 is a view of an outside surface of a receptacle housing portion of the electrical adapter of FIGS. 1-3.
Figure 7:
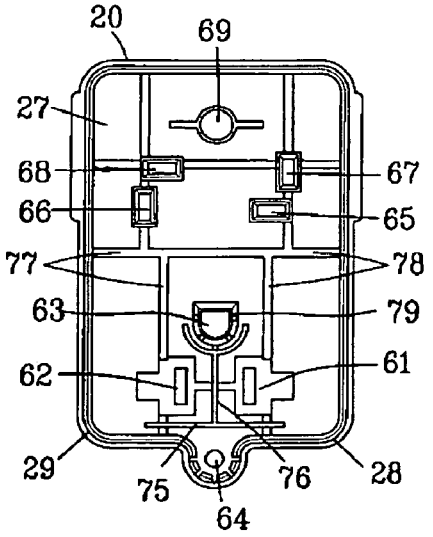
FIG. 7 is a view of an inside surface of the receptacle housing portion of FIG. 6.

FIGS. 6 and 7 illustrate the receptacle housing portion 20 having an outer surface 26 and an inner surface 27. A peripheral wall 28 extends from the inner surface 27 and terminates in a distal end 29. A plurality of receptacle apertures 61-63 extend between the outer surface 26 and the inner surface 27 of the receptacle housing portion 20. The receptacle apertures 61-63 are defined within the receptacle housing portion 20 for enabling the electrical blades 41-43 of the external electrical plug 40 to extend through the receptacle apertures 61-63, respectively. In this example, the receptacle apertures 61-63 are orientated to receive the electrical blades 41-43 of the external electrical plug 40 of a conventional 120 volt 15 ampere electrical service. An illuminator aperture 64 is provided for the illuminator device 90 as shown in FIG. 8.

The receptacle housing portion 20 has a plurality of blade supports 65-69 for retaining the plurality of electrical blades 11-13 within the plurality of blade apertures 51-53 of the plug housing portion 10. Each of the plurality of blade supports 65-69 extends from the inner surface 27 of the receptacle housing portion 20 for retaining the plurality of electrical blades 11-13 within the plurality of blade apertures 51-53 of the plug housing portion 10. The specific operation of the blade supports 65-69 will be described in greater detail with reference to FIGS. 9 and 10.

Receptacle housing shields 75 and 76 extend from the receptacle housing portion 20 for providing insulating walls between the receptacle apertures 61-63 within the receptacle housing portion 20. Strengthening ribs 77 and 78 extend outwardly from the inner surface 27 for providing mechanical strength to the receptacle housing portion 20. Preferably, the receptacle housing portion 20 is molded as a one piece unit from a polymeric material. Preferably, pins are inserted into a mold (not shown) for forming the receptacle apertures 61-63 during the molding process.

Figure 8:
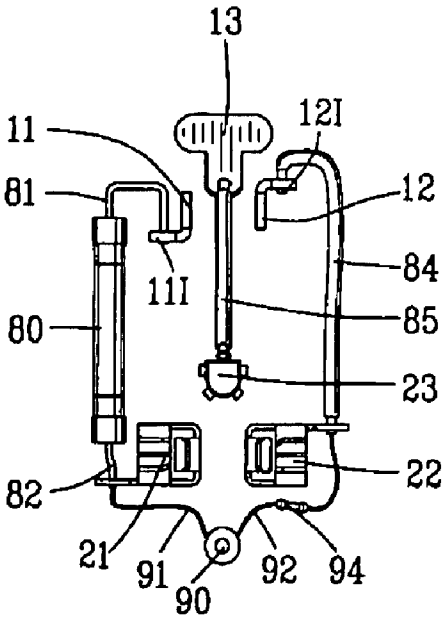
FIG. 8 is a view of a first embodiment of an electrical circuit for the electrical adapter of FIGS. 1-7.

FIG. 8 is a view of a first embodiment of an electrical circuit for the electrical adapter 5 of FIGS. 1-7. The electrical blades 11 and 12 include inner ends 11I and 12I extending into the housing 8 when the electrical blades 11 and 12 are positioned within the blade apertures 51 and 52. The inner ends 11I and 12I of the electrical blades 11 and 12 are bent perpendicular to the portion of the electrical blades 11 and 12 extending from the outer surface 16 of the plug housing portion 10. The bend between the inner ends 11I and 12I and the portion of the electrical blades 11 and 12 extending from the outer surface 16 of the plug housing portion 10 provides a stop for positioning the electrical blades 11 and 12 within the blade apertures 51 and 52. The electrical receptacles 21 and 22 are designed to receive electrical blades from an external electrical plug orientated in a vertical orientation as shown in FIG. 1.

The over current fuse 80 comprises a first and a second terminal 81 and 82. The first terminal 81 is connected to the line blade 11 whereas the second terminal 82 is connected to the line receptacle 21. An insulated conductor 84 interconnects the neutral blade 12 to the neutral receptacle 22. A conductor 85 interconnects the ground blade 13 to the ground receptacle 23.

The illuminator device 90 comprises a first and a second connector 91 and 92. The first connector 91 is connected to the line receptacle 21. The second connector 92 is connected through a current limiting resistor to the neutral receptacle 22.

Figure 9:
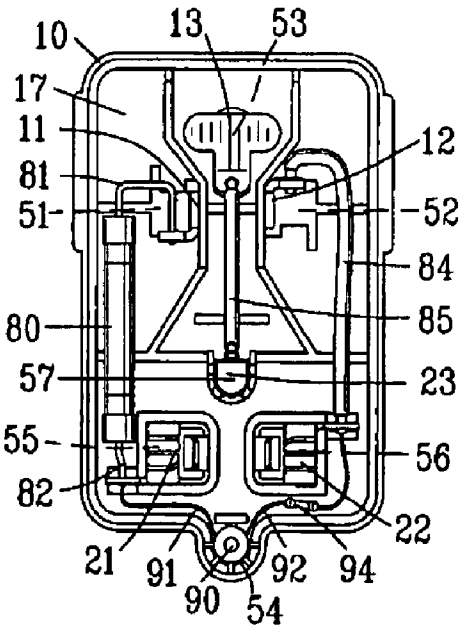
FIG. 9 is a view of the inside surface of the plug housing portion of FIG. 4 containing the first embodiment of the electrical circuit of FIG. 8.

FIG. 9 is a view of the inside surface of the plug housing portion 10 of FIG. 4 containing the first embodiment of the electrical circuit of FIG. 8. The electrical blades 11-13 are located within the blade apertures 51-53. The electrical receptacles 21-23 are located within the receptacle sockets 55-57. The illuminator device 90 is located within the illuminator socket 54 of the plug housing portion 10.

Figure 10:
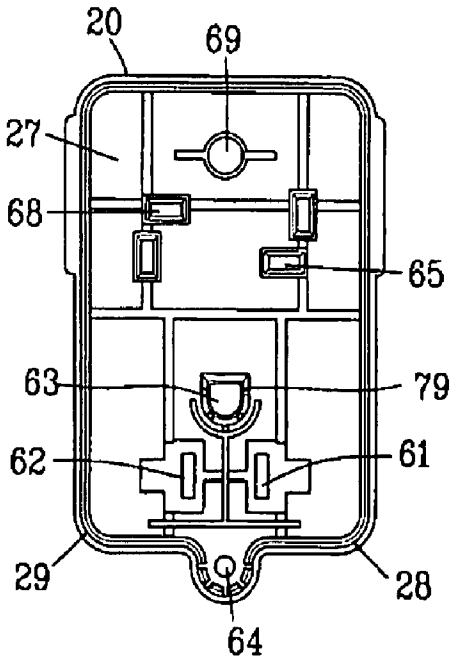
FIG. 10 is a view of the inside surface of the receptacle housing portion for mating with the plug housing portion of FIG. 9.

FIG. 10 is a view of the inside surface 27 of the receptacle housing portion 20 for mating with the plug housing portion 10 of FIG. 9. The distal end 19 of the plug housing portion 10 is secured to the distal end 19 of the receptacle housing portion 20. Preferably, the distal end 19 of the plug housing portion 10 is secured permanently to the distal end 19 of the receptacle housing portion 20 by suitable means such as adhesives, sonic or ultra sonic welding and any other suitable means.

When the distal end 19 of the plug housing portion 10 is secured to the distal end 19 of the receptacle housing portion 20, the plug housing portion 10 cooperates with the receptacle housing portion 20 to secure the electrical blades 11-13, the electrical receptacles 21-23 and the illuminator device 90 within the housing 8.

The inner end 11I of the electrical blade 11 is received within the blade support 65 of the receptacle housing portion 20 for retaining the electrical blade 11 within the blade aperture 51. Similarly, the inner end 12I of the electrical blade 12 is received within the blade support 68 of the receptacle housing portion 20 for retaining the electrical blade 12 within the blade aperture 52. The blade support 69 of the receptacle housing portion 20 engages with the electrical blade 13 for retaining the electrical blade 13 within the blade aperture 53. The illuminator device 90 is retained within the socket 54 of the plug housing portion 10 by the first and second connectors 91 and 92.

The inner surface 27 of the receptacles housing portion 20 engages with the electrical receptacles 21 and 22 to retain the plurality of electrical receptacles 21 and 22 within the sockets 55 and 56 of the plug housing portion 10. A projection 79 extends from the inner surface 27 of the receptacles housing portion 20 for retaining the electrical receptacles 23 within the sockets 57 of the plug housing portion 10. The plurality of the receptacle apertures 61-63 are aligned with the plurality of electrical receptacles 21-23 for enabling the electrical blades 41-43 of the external electrical plug 40 to extend through the receptacle apertures 61-63 to engage with the electrical receptacles 21-23.

The electrical adapter 5 provides an electrical power connection with over current protection between the conventional electrical receptacle 30 and the external electrical plug 40. The over current fuse 80 interconnects the one of the plurality of electrical blades 11-13 to one of the plurality of electrical receptacles 21-23 for providing an electrical power connection and provides over current protection between the conventional electrical receptacle 30 and the external electrical plug 40. Preferably, the over current fuse 80 is located in the line side a 120 volt electrical supply. The over current fuse 80 may be located in either side of a 240 volt electrical supply. The illuminator device 90 is illuminated when the over current fuse 80 provides electrical power connection between the conventional electrical receptacle 30 and the external electrical plug 40.

In the event of an excess current flow between the conventional electrical receptacle 30 and the external electrical plug 40, the over current fuse 80 opens to terminate electrical current flow between the conventional electrical receptacle 30 and the external electrical plug 40. The termination of electrical current flow between the conventional electrical receptacle 30 and the external electrical plug 40 terminates illumination of the illuminator device 90.

Figure 11:
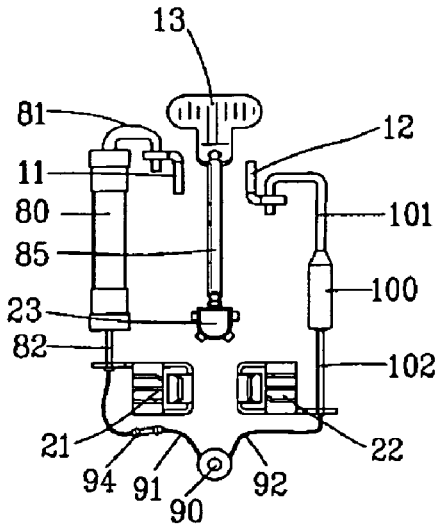
FIG. 11 is a view of a second embodiment of an electrical circuit for the electrical adapter of FIGS. 1-7.
Figure 12:
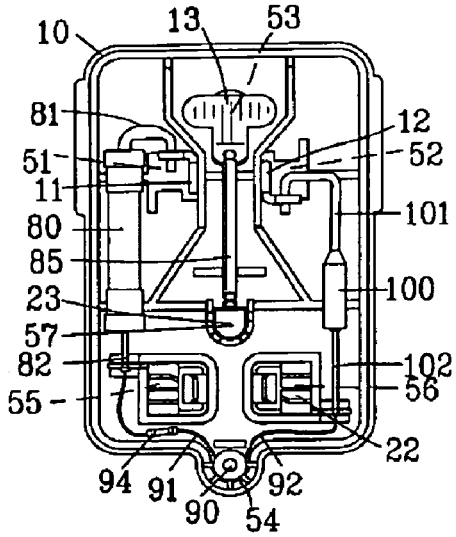
FIG. 12 is a view of the inside surface of the plug housing portion of FIG. 4 containing the second embodiment of the electrical circuit of FIG. 11.

FIGS. 11 and 12 illustrate a second embodiment of an electrical circuit for the electrical adapter 5 of FIGS. 1-7. The second embodiment incorporates a thermal fuse 100 located between a first and a second terminal 101 and 102. The thermal fuse 100 provides electrical conduction between the first and second terminals 101 and 102 during a normal temperature operation of the thermal fuse 100. In the event of an excess temperature of the thermal fuse 100, the thermal fuse 100 terminates electrical conduction between the first and second terminals 101 and 102.

The first terminal 101 is connected to the electrical blade 12 whereas the second terminal 102 is connected to the electrical receptacle 22. The first and second terminals 101 and 102 provide thermal connection to the thermal fuse 100 from the electrical blade 12 and from the electrical receptacle 22. In the event of an overheated condition of either the electrical blade 12 or the electrical receptacle 22, the overheated condition is thermally transferred to the thermal fuse 100 through either of the first and the second terminals 101 and 102. The overheated condition thermally transferred to the thermal fuse 100 terminates electrical conduction of the thermal fuse 100 and electrical conduction between the conventional electrical receptacle 30 and the external electrical plug 40. The termination of electrical current flow between the conventional electrical receptacle 30 and the external electrical plug 40 terminates illumination of the illuminator device 90.

Figure 13:
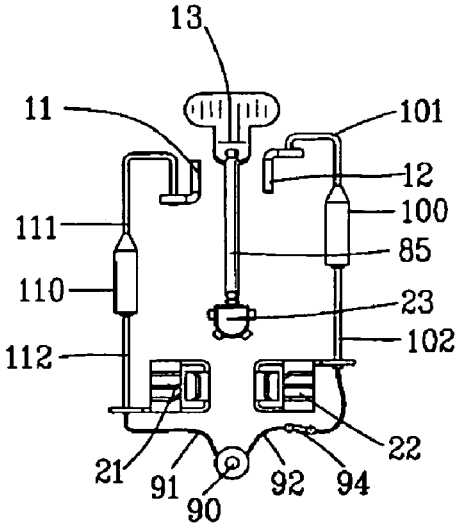
FIG. 13 is a view of a third embodiment of an electrical circuit for the electrical adapter of FIGS. 1-7.
Figure 14:
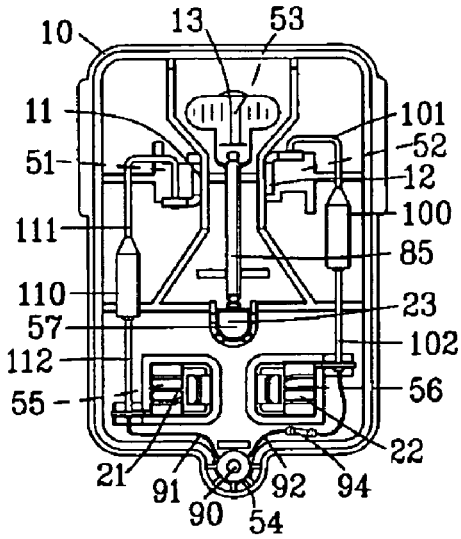
FIG. 14 is a view of the inside surface of the plug housing portion of FIG. 4 containing the third embodiment of the electrical circuit of FIG. 13.

FIGS. 13 and 14 illustrate a third embodiment of an electrical circuit for the electrical adapter 5 of FIGS. 1-7. The third embodiment incorporates a plural thermal fuses 100 and 110. The thermal fuse 100 is located between the first and second terminals 101 and 102. The thermal fuse 110 is located between a first and a second terminal 111 and 112.

The first terminal 101 of the thermal fuse 100 is connected to the electrical blade 11 whereas the second terminal 102 is connected to the electrical receptacle 12. The first terminal 111 of the thermal fuse 110 is connected to the electrical blade 12 whereas the second terminal 112 is connected to the electrical receptacle 22.

In the event of an overheated condition of either the electrical blade 11 or the electrical receptacle 21, the overheated condition is thermally transferred to the thermal fuse 110 to terminate electrical conduction of the thermal fuse 110 and electrical conduction between the conventional electrical receptacle 30 and the external electrical plug 40. In the event of an overheated condition of either the electrical blade 12 or the electrical receptacle 22, the overheated condition is thermally transferred to the thermal fuse 100 to terminate electrical conduction of the thermal fuse 100 and electrical conduction between the conventional electrical receptacle 30 and the external electrical plug 40. The termination of electrical current flow between the conventional electrical receptacle 30 and the external electrical plug 40 terminates illumination of the illuminator device 90.

Figure 15:
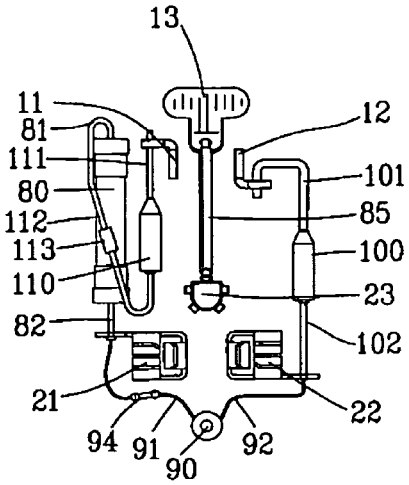
FIG. 15 is a view of a fourth embodiment of an electrical circuit for the electrical adapter of FIGS. 1-7.
Figure 16:
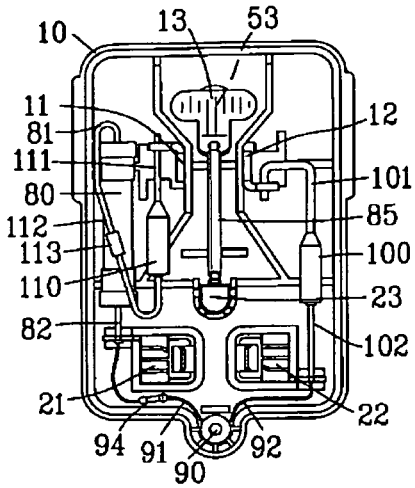
FIG. 16 is a view of the inside surface of the plug housing portion of FIG. 4 containing the fourth embodiment of the electrical circuit of FIG. 15.

FIGS. 15 and 16 illustrate a fourth embodiment of an electrical circuit for the electrical adapter 5 of FIGS. 1-7. The fourth embodiment incorporates the over current fuse 80 as well as plural thermal fuses 100 and 110. The first terminal 101 of the thermal fuse 100 is connected to the electrical blade 12 whereas the second terminal 102 is connected to the electrical receptacle 22.

The first terminal 111 of the thermal fuse 110 is connected to the electrical blade 11. The second terminal 112 of the thermal fuse 110 is connected through a connector 113 to the first terminal 81 of the over current fuse 80. The second terminal 82 of the over current fuse 80 is connected to the electrical receptacle 21.

In the event of an excess current flow between the conventional electrical receptacle 30 and the external electrical plug 40, the over current fuse 80 opens to terminate electrical current flow between the conventional electrical receptacle 30 and the external electrical plug 40.

In the event of an overheated condition of the electrical blade 11, the overheated condition is thermally transferred to the thermal fuse 110 to terminate electrical conduction of the thermal fuse 110 and electrical conduction between the conventional electrical receptacle 30 and the external electrical plug 40. In the event of an overheated condition of either the electrical blade 12 or the electrical receptacle 22, the overheated condition is thermally transferred to the thermal fuse 100 to terminate electrical conduction of the thermal fuse 100 and electrical conduction between the conventional electrical receptacle 30 and the external electrical plug 40. The termination of electrical current flow between the conventional electrical receptacle 30 and the external electrical plug 40 terminates illumination of the illuminator device 90.

Figure 17:
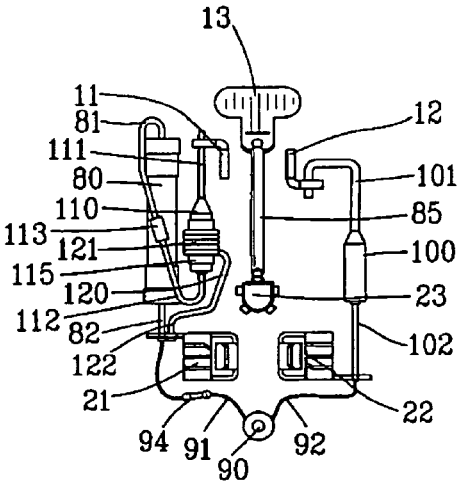
FIG. 17 is a view of a fifth embodiment of an electrical circuit for the electrical adapter of FIGS. 1-7.
Figure 18:
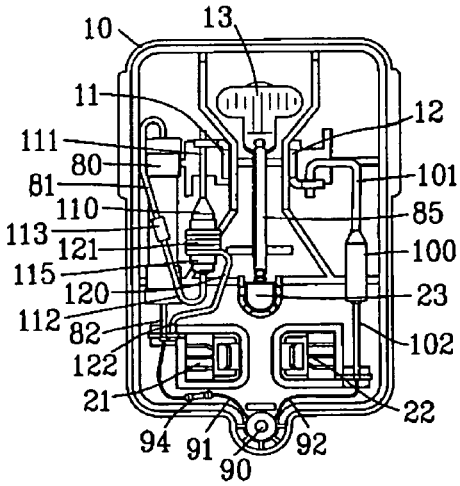
FIG. 18 is a view of the inside surface of the plug housing portion of FIG. 4 containing the fifth embodiment of the electrical circuit of FIG. 17.

FIGS. 17 and 18 illustrate a fifth embodiment of an electrical circuit for the electrical adapter 5 of FIGS. 1-7. The fifth embodiment incorporates the over current fuse 80 as well as plural thermal fuses 100 and 110. In addition, the thermal fuse 110 is connected to transfer heat from both the electrical blade 11 and the electrical receptacle 21.

The first terminal 101 of the thermal fuse 100 is connected to the electrical blade 12 whereas the second terminal 102 is connected to the electrical receptacle 22. The first terminal 111 of the thermal fuse 110 is connected to the electrical blade 11. The second terminal 112 of the thermal fuse 110 is connected through a connector 113 to the first terminal 81 of the over current fuse 80. The second terminal 82 of the over current fuse 80 is connected to the electrical receptacle 21.

Figure 19:
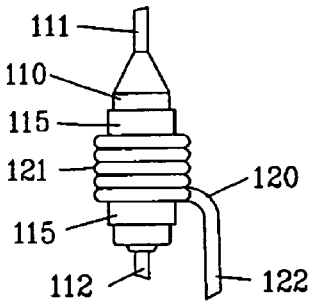
FIG. 19 is an enlarged view of a thermal fuse of FIGS. 17 and 18.
Figure 20:
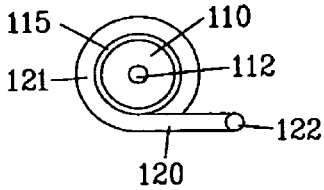
FIG. 20 is an end view of FIG. 19.

FIGS. 19 and 20 are enlarged views of the thermal fuse 110 of FIGS. 17 and 18. The thermal fuse 110 is provided with a thermal conductive and electrically non-conductive layer 115. An electrically and thermally wire 120 extends between a first and a second end 12I and 122. The first end 12I of the wire 120 is coiled around the thermal conductive and electrically non-conductive layer 115 of the thermal fuse 110. The first end 12I of the wire 120 is connected to the electrical receptacle 21.

In the event of an excess current flow between the conventional electrical receptacle 30 and the external electrical plug 40, the over current fuse 80 opens to terminate electrical current flow between the conventional electrical receptacle 30 and the external electrical plug 40.

In the event of an overheated condition of either the electrical blade 11 or the electrical receptacle 21, the overheated condition is thermally transferred to the thermal fuse 110 to terminate electrical conduction of the thermal fuse 110 and electrical conduction between the conventional electrical receptacle 30 and the external electrical plug 40. In the event of an overheated condition of either the electrical blade 12 or the electrical receptacle 22, the overheated condition is thermally transferred to the thermal fuse 100 to terminate electrical conduction of the thermal fuse 100 and electrical conduction between the conventional electrical receptacle 30 and the external electrical plug 40. The termination of electrical current flow between the conventional electrical receptacle 30 and the external electrical plug 40 terminates illumination of the illuminator device 90.

FIGS. 21-38 illustrate a second embodiment of an electrical adapter 5A of the present invention. The second embodiment of the electrical adapter 5A shown in FIGS. 21-38 are similar to the first embodiment of the electrical adapter 5A shown in FIGS. 1-18 with the same reference characters refer to the same parts in the drawings.

The electrical adapter 5A includes a housing 8A comprising a plug housing portion 10A and a receptacle housing portion 20A. A plurality of electrical blades 11-13 are supported by the plug housing portion 10A to protrude from the plug housing portion 10A. A plurality of electrical receptacles 21-23 are supported within the receptacle housing portion 20A.

A conventional electrical receptacle 30A comprises electrical receptacles 31 and 32 and a ground electrical receptacle 33. The conventional electrical receptacle 30A is shown as a conventional NEMA 6-20R 208/240 volt 20 ampere electrical service. A conventional external electrical plug 40A comprises blades 41 and 42 and a ground blade 43. A power cord 45 interconnects the electrical blades 41-43 to a load (not shown).

The electrical blades 11-13 of the plug housing portion 10A are insertable into conventional electrical receptacle 30A. The electrical blades 41-43 of the conventional external electrical plug 40A are insertable into electrical receptacles 21-23 of the receptacle housing portion 20A. The electrical adapter 5A incorporates an over current fuse 80 interconnects the one of the plurality of electrical blades 11 and 12 to one of the plurality of electrical receptacles 21 and 22 for providing over current protection between the conventional electrical receptacle 30A and the external electrical plug 40A.

Figure 23:
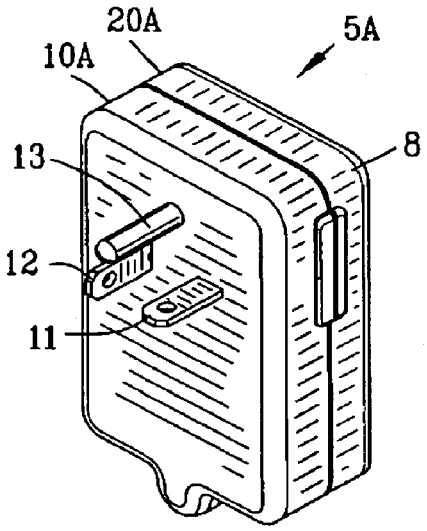
FIG. 23 is an isometric rear view of the electrical adapter of FIG. 21.
Figure 24:
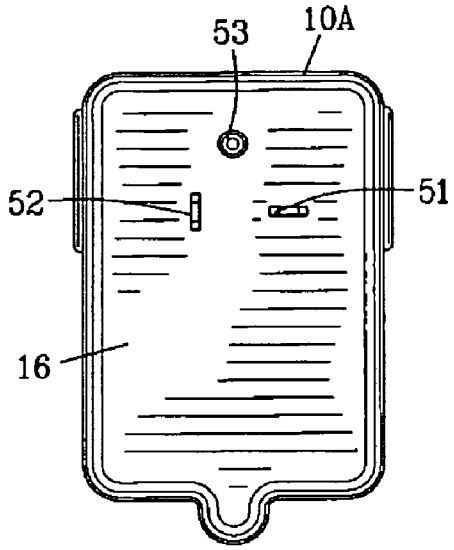
FIG. 24 is a view of an outside surface of a plug housing portion of the electrical adapter of FIGS. 21-23.
Figure 25:
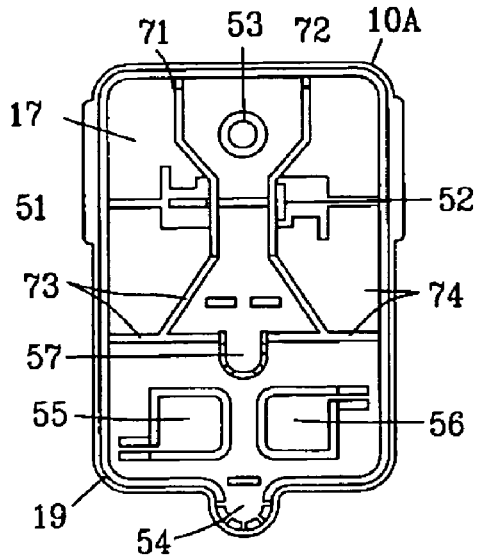
FIG. 25 is a view of an inside surface of the plug housing portion of FIG. 24.

FIGS. 24 and 25 illustrate the plug housing portion 10A having an outer surface 16 and an inner surface 17. A peripheral wall 18 extends from the inner surface 17 and terminates in a distal end 19. A plurality of blade apertures 51-53 extend between the outer surface 16 and the inner surface 17 of the plug housing portion 10A. The blade apertures 51-53 are defined within the plug housing portion 10A for enabling the plurality of electrical blades 11-13 to extend through the blade apertures 51-53 with the proper blade orientation. In this example, the blade apertures 51 and 52 are orientated to position the electrical blades 11 and 12 in a perpendicular relationship as shown in FIGS. 23 and 24 for use with a conventional NEMA 6-20P 208/240 volt 20 ampere electrical service.

The plug housing portion 10A includes a plurality of sockets 54-57 defined within the plug housing portion 10A. An illuminator socket 54 is provided for mounting an illuminator device 90. Receptacle sockets 55-57 are defined within the within the plug housing portion 10A for receiving the receptacle 21, the receptacle 22 and the ground receptacle 23, respectively.

The plug housing portion 10A is molded as a one piece unit from a polymeric material in a manner similar to the plug housing portion 10 shown in FIGS. 1-18. A reorientation of the pins inserted into the mold (not shown) form the blade apertures 51-53 during the molding process shown in FIGS. 21-27. The reorientation of the pins inserted into the mold (not shown) enable the same mold to produce the plug housing portion 10 shown in FIGS. 1-7 as well as the plug housing portion 10A shown in FIGS. 21-27.

Figure 26:
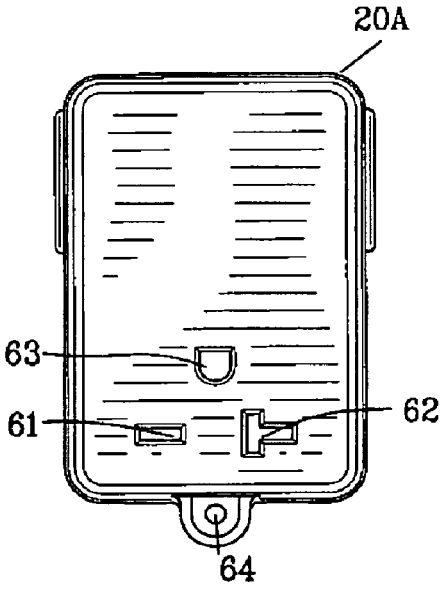
FIG. 26 is a view of an outside surface of a receptacle housing portion of the electrical adapter of FIGS. 21-23.
Figure 27:
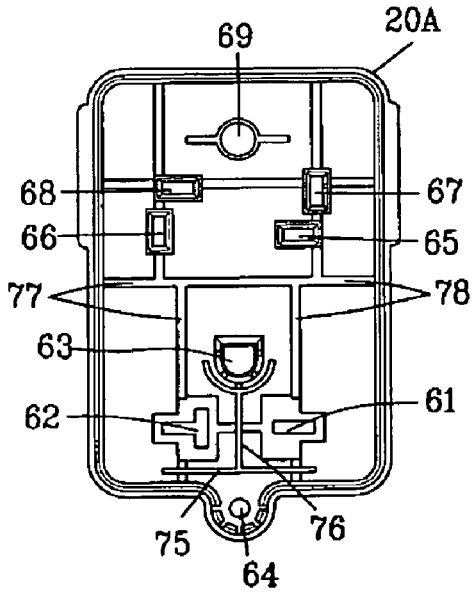
FIG. 27 is a view of an inside surface of the receptacle housing portion of FIG. 26.

FIGS. 26 and 27 illustrate the receptacle housing portion 20A having an outer surface 26 and an inner surface 27. A peripheral wall 28 extends from the inner surface 27 and terminates in a distal end 29. A plurality of receptacle apertures 61-63 extend between the outer surface 26 and the inner surface 27 of the receptacle housing portion 20A. The receptacle apertures 61-63 are defined within the receptacle housing portion 20A for enabling the electrical blades 41-43 of the external electrical plug 40A to extend through the receptacle apertures 61-63, respectively. In this example, the receptacle apertures 61-63 are orientated to receive the electrical blades 41-43 of the external electrical plug 40A of a conventional NEMA 6-20P 208/240 volt 20 ampere electrical service or a NEMA 6-15P 208/240 volt 15 ampere electrical service. An illuminator aperture 64 is provided for the illuminator device 90 as shown in FIG. 28.

The receptacle housing portion 20A has a plurality of blade supports 65-69 for retaining the plurality of electrical blades 11-13 within the plurality of blade apertures 51-53 of the plug housing portion 10A. Each of the plurality of blade supports 65-69 extends from the inner surface 27 of the receptacle housing portion 20A for retaining the plurality of electrical blades 11-13 within the plurality of blade apertures 51-53 of the plug housing portion 10A. The specific operation of the blade supports 65-69 will be described in greater detail with reference to FIGS. 29 and 30.

The receptacle housing portion 20A is molded as a one piece unit from a polymeric material in a manner similar to the receptacle housing portion 20A in FIGS. 1-18. A reorientation of the pins inserted into the mold (not shown) form the receptacle apertures 61-63 during the molding process shown in FIGS. 21-27. The reorientation of the pins inserted into the mold (not shown) enable the same mold to produce the receptacle housing portion 20 shown in FIGS. 1-7 as well as the receptacle housing portion 20A shown in FIGS. 21-27.

Figure 30:
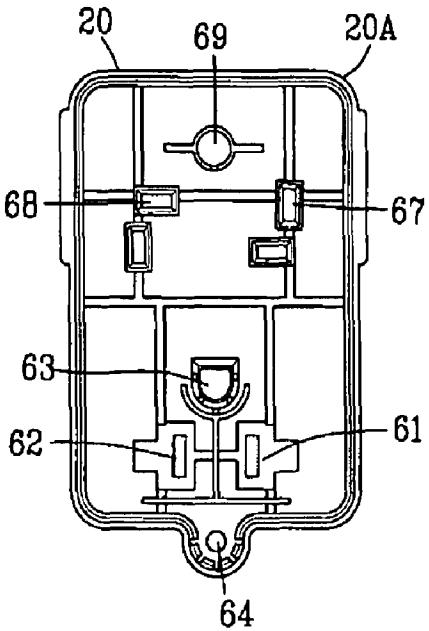
FIG. 30 is a view of the inside surface of the receptacle housing portion for mating with the plug housing portion of FIG. 29.
Figure 29:
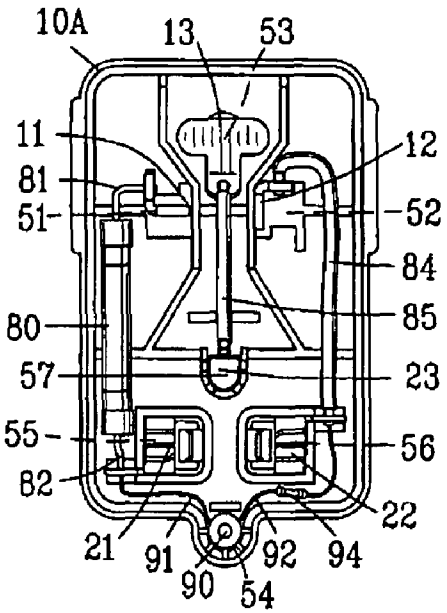
FIG. 29 is a view of the inside surface of the plug housing portion of FIG. 24 containing the first embodiment of the electrical circuit of FIG. 28.
Figure 28:
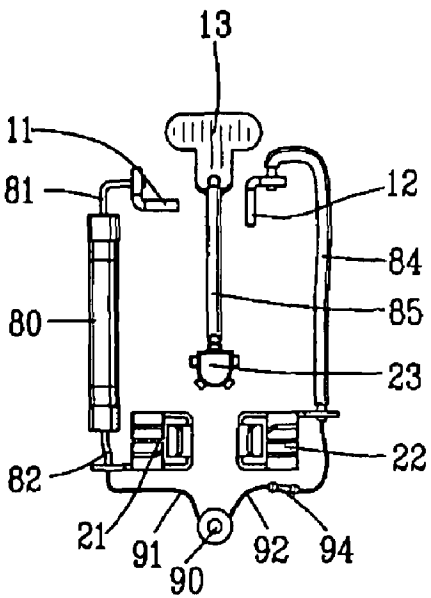
FIG. 28 is a view of a first embodiment of an electrical circuit for the electrical adapter of FIGS. 21-27.

FIGS. 28-30 illustrate the second first embodiment of an electrical circuit for the electrical adapter 5A of FIGS. 21-27. The electrical blades 11 and 12 include inner ends 11I and 12I extending into the housing 8 when the electrical blades 11 and 12 are positioned within the blade apertures 51 and 52. The inner ends 11I and 12I of the electrical blades 11 and 12 are bent perpendicular to the portion of the electrical blades 11 and 12 extending from the outer surface 16 of the plug housing portion 10A. The bend between the inner ends 11I and 12I and the portion of the electrical blades 11 and 12 extending from the outer surface 16 of the plug housing portion 10A provides a stop for positioning the electrical blades 11 and 12 within the blade apertures 51 and 52.

Figure 21:
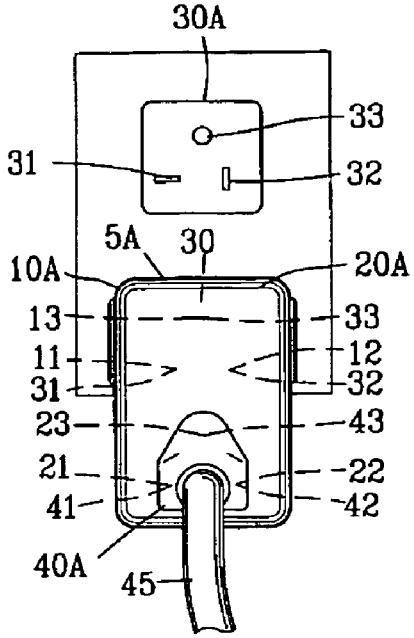
FIG. 21 is a front view of a second embodiment of an electrical adapter of the present invention inserted into a conventional electrical receptacle.
Figure 22:
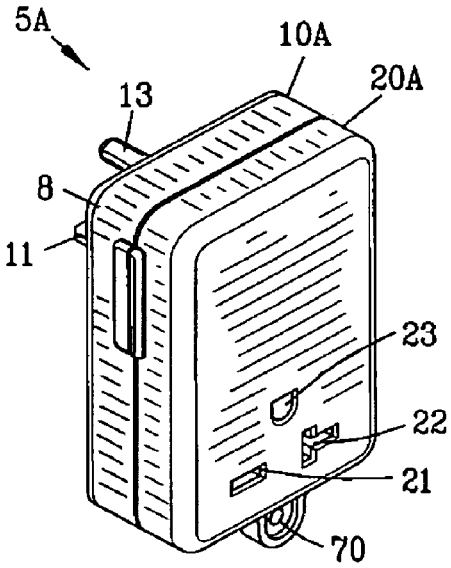
FIG. 22 is an isometric front view of the electrical adapter of FIG. 21.

Each of the electrical receptacles 21-22 is designed to receive an electrical blade from an external electrical plug orientated in either a vertical orientation as shown in FIG. 21 or and is designed to receive an electrical blade from an external electrical plug orientated in a horizontal orientation as shown in FIG. 20.

The over current fuse 80 is connected between the blade 11 and the receptacle 21. The insulated conductor 84 interconnects the blade 12 to the receptacle 22. The conductor 85 interconnects the ground blade 13 to the ground receptacle 23. The illuminator device 90 is connected between receptacle 21 and the to the receptacle 22 through a current limiting resistor to the receptacle 22.

In contrast to FIG. 10, the inner end 11I of the electrical blade 11 is received within the blade support 67 of the receptacle housing portion 20A for retaining the electrical blade 11 within the blade aperture 51. The inner end 12I of the electrical blade 12 is received within the blade support 68 of the receptacle housing portion 20A for retaining the electrical blade 12 within the blade aperture 52. The blade support 69 of the receptacle housing portion 20A engages with the electrical blade 13 for retaining the electrical blade 13 within the blade aperture 53. The illuminator device 90 is retained within the socket 54 of the plug housing portion 10A by the first and second connectors 91 and 92.

The inner surface 27 of the receptacles housing portion 20A engages with the electrical receptacles 21 and 22 to retain the plurality of electrical receptacles 21 and 22 within the sockets 55 and 56 of the plug housing portion 10A. A projection 79 extends from the inner surface 27 of the receptacles housing portion 20A for retaining the electrical receptacles 23 within the sockets 57 of the plug housing portion 10A. The plurality of the receptacle apertures 61-63 are aligned with the plurality of electrical receptacles 21-23 for enabling the electrical blades 41-43 of the external electrical plug 40A to extend through the receptacle apertures 61-63 to engage with the electrical receptacles 21-23. The electrical adapter 5A provides an electrical power connection with over current protection between the conventional electrical receptacle 30A and the external electrical plug 40A as described with reference to FIG. 10.

Figure 31:
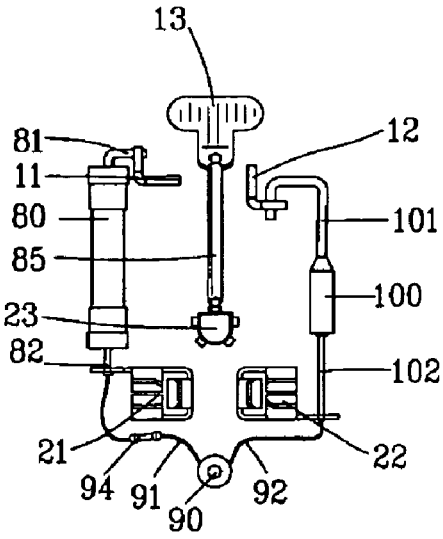
FIG. 31 is a view of a second embodiment of an electrical circuit for the electrical adapter of FIGS. 21-27.
Figure 32:
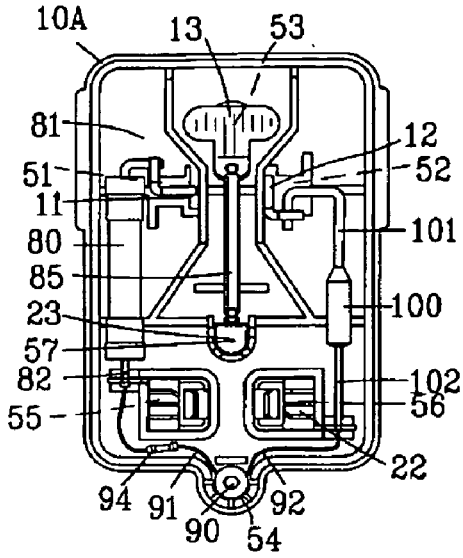
FIG. 32 is a view of the inside surface of the plug housing portion of FIG. 24 containing the second embodiment of the electrical circuit of FIG. 31.

FIGS. 31 and 32 illustrate a second embodiment of an electrical circuit for the electrical adapter 5A of FIGS. 21-27. The second embodiment incorporates a thermal fuse 100 connected between the electrical blade 12 and the electrical receptacle 22. This second embodiment of the electrical adapter 5A operates in a manner described with reference to FIGS. 11 and 12.

Figure 33:
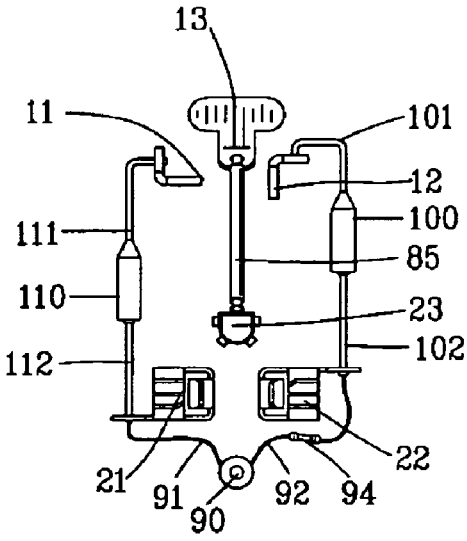
FIG. 33 is a view of a third embodiment of an electrical circuit for the electrical adapter of FIGS. 21-27.
Figure 34:
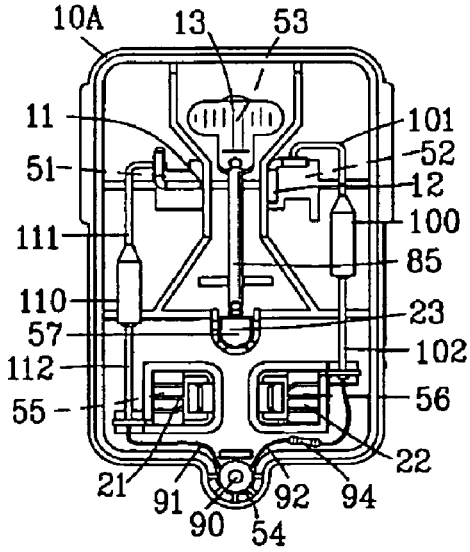
FIG. 34 is a view of the inside surface of the plug housing portion of FIG. 24 containing the third embodiment of the electrical circuit of FIG. 33.

FIGS. 33 and 34 illustrate a third embodiment of an electrical circuit for the electrical adapter 5A of FIGS. 21-27. The third embodiment incorporates a plural thermal fuses 100 and 110. This third embodiment of the electrical adapter 5A operates in a manner described with reference to FIGS. 13 and 14.

Figure 35:
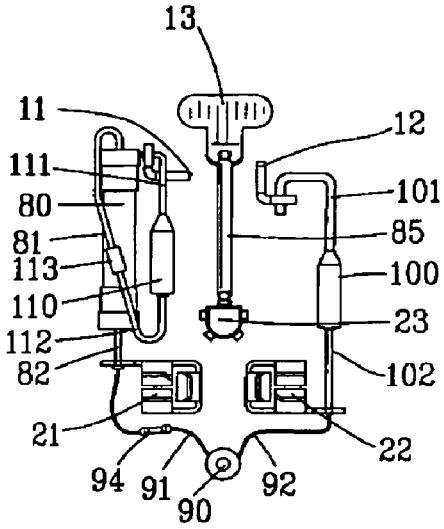
FIG. 35 is a view of a fourth embodiment of an electrical circuit for the electrical adapter of FIGS. 21-27.
Figure 36:
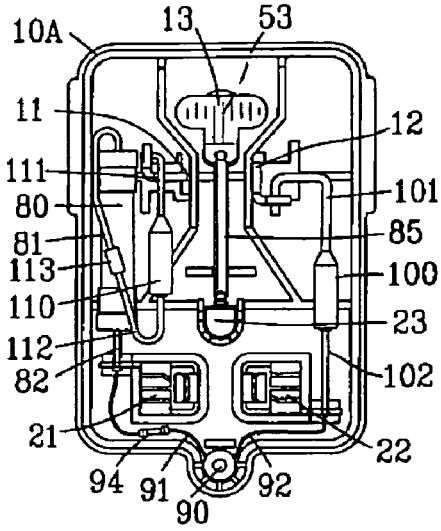
FIG. 36 is a view of the inside surface of the plug housing portion of FIG. 24 containing the fourth embodiment of the electrical circuit of FIG. 35.

FIGS. 35 and 36 illustrate a fourth embodiment of an electrical circuit for the electrical adapter 5A of FIGS. 21-27. The fourth embodiment incorporates the over current fuse 80 as well as plural thermal fuses 100 and 110. This fourth embodiment of the electrical adapter 5A operates in a manner described with reference to FIGS. 15 and 16.

Figure 37:
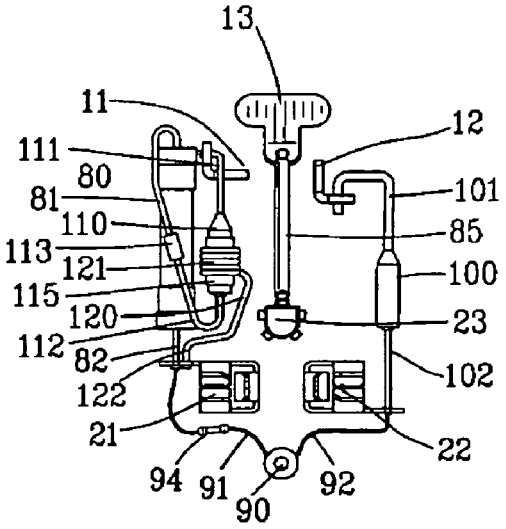
FIG. 37 is a view of a fifth embodiment of an electrical circuit for the electrical adapter of FIGS. 21-27.
Figure 38:
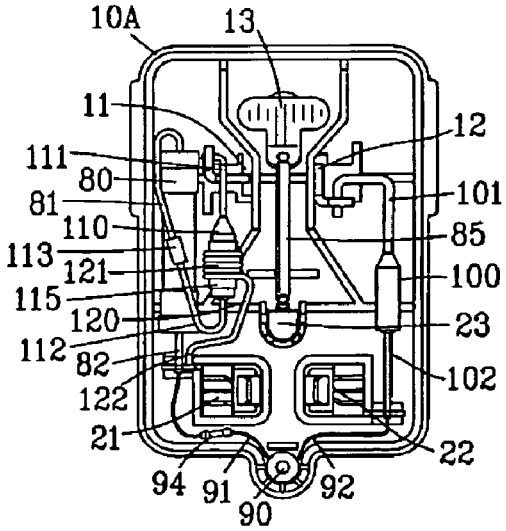
FIG. 38 is a view of the inside surface of the plug housing portion of FIG. 24 containing the fifth embodiment of the electrical circuit of FIG. 37.

FIGS. 37 and 38 illustrate a fifth embodiment of an electrical circuit for the electrical adapter 5A of FIGS. 21-27. The fifth embodiment incorporates the over current fuse 80 as well as plural thermal fuses 100 and 110. In addition, the thermal fuse 110 is connected to transfer heat from both the electrical blade 11 and the electrical receptacle 21. This fifth embodiment of the electrical adapter 5A operates in a manner described with reference to FIGS. 17 and 18.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An electrical adapter for providing current overload protection and over heating protection between a conventional electrical receptacle and an external electrical plug, comprising:

a housing having a plug housing portion and a receptacle housing portion;

a plurality of electrical blades supported by said plug housing portion to protrude from said plug housing portion for insertion within the conventional electrical receptacle;

a plurality of electrical receptacles supported within said housing for receiving an external conventional electrical plug;

an over current fuse interconnecting one of said plurality of electrical blades to one of said plurality of electrical receptacles for providing over current protection between the conventional electrical receptacle and the external electrical plug;

a thermal fuse located in thermal contact with at least one of said plurality electrical blades and said plurality electrical receptacles for terminating electrical conduction between the conventional electrical receptacle and the external electrical plug upon an over heated condition of the electrical adapter;

said over current fuse is connected between one of said plurality electrical blades and one of said plurality of electrical receptacles; and said thermal fuse being connected between the other of said plurality electrical blades and the other of said plurality of electrical receptacles.

2. An electrical adapter for providing current overload protection and over heating protection between a conventional electrical receptacle and an external electrical plug, comprising:

a housing having a plug housing portion and a receptacle housing portion;

a plurality of electrical blades supported by said plug housing portion to protrude from said plug housing portion for insertion within the conventional electrical receptacle;

a plurality of electrical receptacles supported within said housing for receiving an external conventional electrical plug;

an over current fuse interconnecting one of said plurality of electrical blades to one of said plurality of electrical receptacles for providing over current protection between the conventional electrical receptacle and the external electrical plug;

a thermal fuse located in thermal contact with at least one of said plurality electrical blades and said plurality electrical receptacles for terminating electrical conduction between the conventional electrical receptacle and the external electrical plug upon an over heated condition of the electrical adapter; and said thermal fuse is connected in series with said over current fuse between one of said plurality electrical blades and one of said plurality of electrical receptacles.

3. An electrical adapter as set forth in claim 2, wherein said plug housing portion is secured to said receptacle housing portion for enclosing said over current fuse.

4. An electrical adapter as set forth in claim 2, wherein said plug housing portion is permanently secured to said receptacle housing portion for enclosing said over current fuse.

5. An electrical adapter as set forth in claim 2, wherein said plug housing portion includes a plurality of blade apertures for enabling said plurality of electrical blades to extend therethrough; and a receptacles housing portion having a plurality of blade supports extending from said receptacles housing portion for retaining said plurality of electrical blades within said plurality of blade apertures of said plug housing portion.

6. An electrical adapter as set forth in claim 2, including an illuminator for indicating electrical conduction of the electrical adapter between the conventional electrical receptacle and the external electrical plug.

7. An electrical adapter as set forth in claim 2, wherein said over current fuse includes a first and a second terminal; and said first and second terminals of said over current fuse interconnecting one of said plurality of electrical blades to one of said plurality of electrical receptacles for providing over current protection between the conventional electrical receptacle and the external electrical plug.

8. An electrical adapter as set forth in claim 2, wherein said thermal fuse includes a first and a second terminal; and said first and second terminals of said thermal fuse interconnecting one of said plurality of electrical blades to one of said plurality of electrical receptacles for providing thermal protection between the conventional electrical receptacle and the external electrical plug.

* * * * *